United States Patent [19]

King et al.

[11] Patent Number: 4,599,542

[45] Date of Patent: Jul. 8, 1986

[54] LINEAR BEAM TUBES

[75] Inventors: Robin C. M. King, Ongar; Maurice Esterson, Chelmsford; John Clarke, Malvern Link, all of England

[73] Assignees: English Electric Valve Company Limited, Chelmsford; The Secretary of State for Defence in Her Britannic Majesty's Government of the United Kingdom of Great Britain and Northern Ireland, London, both of England

[21] Appl. No.: 634,484

[22] Filed: Jul. 26, 1984

[30] Foreign Application Priority Data

Jul. 30, 1983 [GB] United Kingdom ..... 8320613

[51] Int. Cl.[4] ..... H01J 29/96; H01J 7/44; H01J 1/96

[52] U.S. Cl. ..... 315/59; 315/3; 313/252; 313/253; 313/285; 313/289

[58] Field of Search ..... 315/59, 58, 61, 3; 313/477 R, 477 HC, 448, 252, 253, 285, 289, 292; 361/10

[56] References Cited

U.S. PATENT DOCUMENTS

| | | | |
|---|---|---|---|
| 2,771,566 | 11/1956 | Baracket | 315/59 X |
| 3,098,169 | 7/1963 | Buckley et al. | 315/3.5 |
| 3,295,008 | 12/1966 | Gallaro et al. | 315/59 X |
| 3,683,235 | 8/1972 | Phillips et al. | 315/5.34 |
| 3,882,348 | 5/1975 | Paridaens | 315/3 X |
| 4,255,689 | 3/1981 | Fischman et al. | 315/3 |
| 4,366,415 | 12/1982 | Takenaka et al. | 313/457 |

FOREIGN PATENT DOCUMENTS

| | | | |
|---|---|---|---|
| 1273703 | 7/1968 | Fed. Rep. of Germany . | |
| 1541078 | 1/1970 | Fed. Rep. of Germany . | |
| 2801916 | 7/1978 | Fed. Rep. of Germany | 315/3 |
| 2937299 | 10/1980 | Fed. Rep. of Germany | 315/3 |
| 57-124835 | 8/1982 | Japan . | |
| 655706 | 8/1951 | United Kingdom . | |
| 872170 | 7/1961 | United Kingdom . | |
| 1199575 | 7/1970 | United Kingdom . | |

OTHER PUBLICATIONS

Yuzuru Kobori et al., "A Novel Arc-Suppression Technique for Cathode Ray Tubes," IEEE Transactions on Consumer Electronics (Aug., 1980), vol. CE-26, pp. 446–451.

*Primary Examiner*—David K. Moore
*Assistant Examiner*—Vincent DeLuca
*Attorney, Agent, or Firm*—Spencer & Frank

[57] ABSTRACT

The invention provides a linear beam tube which may be protected against high voltage arcs between the cathode and anode of its electron gun by connecting to ground a limiting impedance in a series path from said anode. The anode is carried upon the end of a ceramic cylinder which is co-axially within a conical metallic member. The end of the ceramic cylinder remote from the anode is attached to one end of said conical metallic member, the other end of which is flanged, with the flange passing through the tube envelope to provide an external termination which may be connected to ground. Resistive material is deposited in a groove in the inner surface of said ceramic cylinder to form a deposited impedance which extends from the anode over the end of the ceramic cylinder, to the end of the conical metallic member and constitutes said limiting impedance.

15 Claims, 4 Drawing Figures

LINEAR BEAM TUBES

BACKGROUND OF THE INVENTION

This invention relates to linear beam tubes and more particularly to the electron guns of such tubes.

The electron gun end of a typical linear beam tube is shown in FIG. 1 of the accompanying drawings.

Referring to FIG. 1 the glass or ceramic envelope of the linear beam tube is represented at 1; the cathode of its electron gun is represented at 2 and the anode of its electron gun is represented at 3. The anode 3 is mounted directly upon the first pole piece 4 of a focussing structure at the entrance of a slow wave structure (not represented but to the right as viewed) of the linear beam tube. Commonly but not necessarily this first pole piece 4 constitutes also an end wall of the first cavity of the slow wave structure. In this case the anode 3, mounted as it is on the first pole piece 4, is held at ground potential and the length of the main cathode voltage insulator (i.e. the length L of the envelope 1 electrically between the cathode 2 and the pole piece 4) is determined by the voltage stand-off requirements external to the tube. Where the tube operates in air the length L requires to be longer than would be the case if the gun end of the tube were to be immersed in a dielectric liquid.

With the configuration of FIG. 1, during high voltage arcs occurring between the cathode 2 and anode 3 these electrodes are prone to damage and for this reason the known configuration shown in FIG. 2 of the accompanying drawing has found some favour by virtue of the protection that may be afforded to the electrodes in the face of such high voltage arcs.

Referring to FIG. 2 in this case the anode electrode 3 is isolated from the pole piece 4 and is mounted upon a metal cylinder 5 which cylinder is in turn supported between two insulating lengths of envelope 1′ with 1″ which are each of length equal to L.

A flange 6 by which the cylinder 5 is mounted, and which is sandwiched between the two lengths of insulator 1′and 1″, forms an electrical connection for the anode 3. Between the electrical connection formed by flange 6 and earth is an external limiting resistor 7. In practice, and as shown, the end of the resistor 7 remote from the flange 6 is grounded by being attached to the first pole piece 4. In some cases grounding is effected not via the first pole piece 4 but via a current sensor.

With the construction of FIG. 2, during normal operation the anode 3 is held close to ground potential since there is negligible anode current drawn. However when an anode to cathode arc occurs a relatively large current flows through the limiting resistor 7 which charges the anode up to cathode potential, thus causing the arc to be extinguished. In this case the anode is at a potential other than ground potential only during such arcs.

Whilst the tube illustrated by FIG. 2 is, as regards cathode to anode arcs, a "protected" tube as opposed to the tube illustrated by FIG. 1 which is an "unprotected" tube, a serious disadvantage arising from the construction of FIG. 2 is the added length of insulating envelope wall, i.e. the two portions 1′ and 1″, between the cathode mount and the first pole piece 4—effectively double that of the construction illustrated by FIG. 1. Whilst this added length is in itself undesirable there is in consequence also a tendency for the gun to be the more susceptible to vibration. Such vibration can give rise to electrical noise which is a serious limitation in some systems.

SUMMARY OF THE INVENTION

The present invention seeks to provide an improved linear beam tube in which the above difficulty is reduced.

According to this invention an electron beam tube comprises an electron gun having at one end thereof a cathode and at the other end thereof an anode, said anode being mounted adjacent to but isolated from an end wall of a structure downstream of said gun and wherein said anode is supported by means of folded mounting means comprised of a first part extending back from said anode towards the cathode end of said gun and a second part extending forward from the end of said first part remote from said anode towards said end wall, one of said two parts being of insulating material and having provided on a surface thereof a limiting impedance which is electrically in series in a path between said anode and an external termination which in operation may be grounded (directly or indirectly e.g. via a current sensor) whereby to permit said anode to tend to charge towards cathode potential if an anode to cathode arc occurs.

Said structure may for example be a focussing structure; wave propagating structure; an electron beam tunnel or the like depending upon the type of linear beam tube to which the invention is applied.

The end of said second part adjacent said end wall may be attached to said end wall or carried from the envelope of said tube at a position adjacent said end wall.

Commonly said end wall will be the first pole piece of a focussing structure, in which case where the end of said second part adjacent to said end wall is attached to said end wall, said pole piece may comprise said external termination.

Preferably said first and second parts of which said folded mounting means is comprised are, in any plane transverse to the beam axis over the major portions of their lengths, generally circular in cross section and co-axial with said beam axis.

Both of said parts may overall be generally cylindrical and united at their ends remote from said end wall and said anode by flange means or at least one of said two parts may be generally conical.

In one embodiment of the invention said first part comprises a ceramic tubular member and said second part comprises a conical metallic member which has a flange at its end remote from said first part which flange extends through the envelope of said tube adjacent said end wall.

Preferably with a construction as last described said limiting impedance is provided on an internal surface of said tubular member comprising said first part, with one end in contact with said anode and the other in contact with said conical metallic member.

In another embodiment of the invention said first part comprises a metallic tubular member co-axially within a ceramic tubular member which comprises said second part, said ceramic tubular member being attached at one end to said end wall and the end of said metallic tubular member remote from said anode being flanged with its flange attached to the end of said ceramic tubular member remote from said end wall.

Preferably with a construction as last described said limiting impedance is provided on an external surface of said tubular member comprising said second part with one end in contact with said flange and the other electrically connected to said external termination.

Said limiting impedance may comprise deposited resistive material preferably deposited within a groove in the surface of that member upon which said limiting impedance is provided as aforesaid.

DESCRIPTION OF THE PREFERRED EMBODIMENTS

Figure 1:
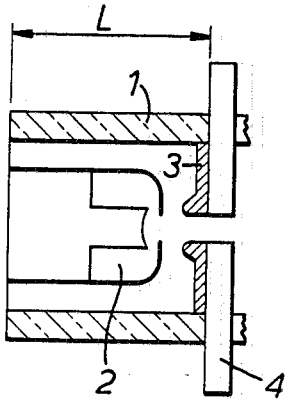
FIGS. 1 and 2 are sectional views illustrating known linear beam tubes.
Figure 2:
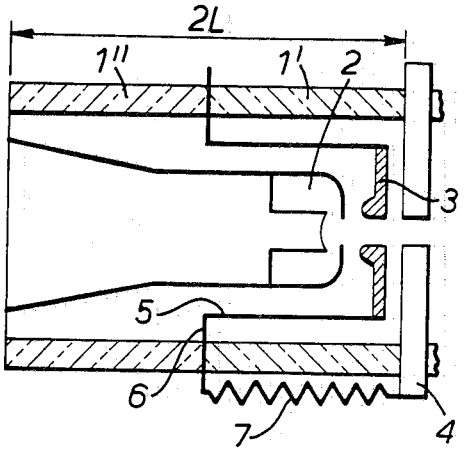
Figure 3:
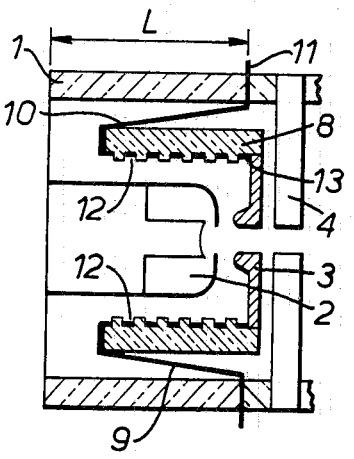
FIGS. 3 and 4 are sectional views illustrating two embodiments of the present invention.
Figure 4:
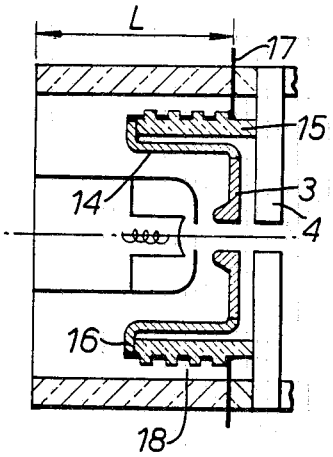

In FIGS. 3 and 4 like references are used for like parts in FIGS. 1 and 2.

Referring to FIG. 3 as will be seen the anode 3 is isolated from the pole piece 4 and is mounted upon a ceramic cylindrical member 8 which extends back towards the cathode end of the electron gun.

The cylindrical ceramic member 8 is supported by means of a flanged conical metallic member 9 which surrounds the cylindrical member 8. One end 10 of the conical member 9 is fixed to the end of the cylindrical ceramic member 8 remote from the anode 3. The other flanged end of the conical member 9 extends through the envelope 1 of the tube to form an external termination 11. The length of envelope between the flange 11 and the mount of the cathode 2 is equal to L.

On the interior surface of the cylindrical ceramic member 8 is deposited within a groove 12 resistive material forming the required limiting impedance. The deposited resistive material extends beyond the groove so that one end 13 of the limiting impedance is in electrical contact with the anode 3 and the other end extends over the end of the cylindrical ceramic member 8 to contact end 10 of the conical metallic member 9. As shown, the resistive material is deposited in the base of the groove 12 and extends only partly up the side walls of the groove.

Thus the limiting impedance is again in series in a path between the anode 3 and the external termination 11. If this termination is grounded then as already described with reference to FIG. 2, arcs occurring between the cathode 2 and the anode 3 may be suppressed. It will be noted however that the overall length of the gun section of the protected tube illustrated by FIG. 3 corresponds more closely to that of the electron gun of the unprotected tube of FIG. 1 than to the lengthy gun section of the protected tube of FIG. 2.

Because the limiting impedance operates in a vacuum within the tube envelope the length of ceramic reuired to hold off the voltage is less than is the case for the resistor 7 of FIG. 2.

Referring to FIG. 4, the anode 3 is again isolated from the pole piece 4. Anode 3 is mounted upon a generally cylindrical metallic member 14 which extends back from the anode 3 towards the cathode end of the electron gun.

Member 14 is co-axially within a cylindrical ceramic member 15 which is mounted at one end on the pole piece 4 and extends back therefrom towards the cathode end of the electron gun.

The end of member 14 remote from the anode 3 is flanged with its flange 16 attached to the end of the ceramic member remote from the pole piece 4.

Passing through the envelope wall 1 adjacent to, but spaced from, the pole piece 4 is an annular metallic member 17 which extends inwardly towards the tube axis to contact the cylindrical ceramic member 15. Member 17 provides an external termination.

On the exterior surface of cylindrical ceramic member 15 is deposited within a groove 18, resistive material forming the required limiting impedance. The deposited impedance formed again extends, beyond the groove, from the flange 16 of cylindrical metallic member 14 to member 17 forming said external termination.

Thus again the limiting impedance is in series in a path between the anode 3 and the external termination formed by member 17 and if the last mentioned is grounded then again as already described with reference to FIG. 2 arcs occurring between the cathode 2 and the anode 3 may be suppressed.

What is claimed is:

1. An electron beam tube comprising an electron gun having at one end thereof a cathode and at the other end thereof an anode, said anode being mounted adjacent to but isolated from an end wall of a structure downstream of said gun and wherein said anode is supported by means of folded mounting means comprised of a first part extending back from said anode towards the cathode end of said gun and a second part extending forward from the end of said first part remote from said anode towards said end wall, one of said two parts being of insulating material and having provided on a surface thereof a limiting impedance which is electrically in series in a path between said anode and an external termination which in operation may be grounded whereby to permit said anode to tend to charge towards cathode potential if an anode to cathode arc occurs.

2. A tube as claimed in claim 1 and wherein said second part has an end that is adjacent said end wall, said end of said second part being attached to said end wall.

3. A tube as claimed in claim 1 and wherein said second part has an end that is adjacent said end wall, said end of said second part being carried from the envelope of said tube at a position adjacent said end wall.

4. A tube as claimed in claim 1 and wherein said end wall is the first pole piece of a focussing structure.

5. A tube as claimed in claim 4 wherein said second part has an end that is adjacent said end wall, said end of said second part being attached to said end wall, and wherein said pole piece comprises said external termination.

6. A tube as claimed in claim 1 and wherein said first and second parts of which said folded mounting means is comprised are, in any plane transverse to the beam axis over the major portions of their lengths, generally circular in cross section and co-axial with said beam axis.

7. A tube as claimed in claim 6 and wherein both of said parts are, overall, cylindrical and united at their ends remote from said end wall and said anode by flange means.

8. A tube as claimed in claim 6 and wherein both of said parts are, overall, generally cylindrical and united at their ends remote from said end wall and at least one of said two parts is generally conical.

9. A tube as claimed in claim 1 and wherein said first part comprises a ceramic tubular member and said second part comprises a conical metallic member which has a flange at its end remote from said first part which flange extends through the envelope of said tube adjacent said end wall.

10. A tube as claimed in claim 9 and wherein said limiting impedance is provided on an internal surface of said tubular member comprising said first part, with one end in contact with said anode and the other in contact with said conical metallic member.

11. A tube as claimed in claim 1 and wherein said first part comprises a metallic tubular member co-axially within a ceramic tubular member which comprises said second part, said ceramic tubular member being attached at one end to said end wall and the end of said metallic tubular member remote from said anode being flanged with its flange attached to the end of said ceramic tubular member remote from said end wall.

12. A tube as claimed in claim 11 and wherein said limiting impedance is provided on an external surface of said tubular member comprising said second part with one end in contact with said flange and the other electrically connected to said external termination.

13. A tube as claimed in claim 1 and wherein said limiting impedance comprises deposited resistive material.

14. A tube as claimed in claim 13 and wherein said resistive material is deposited in a groove in the surface of that member upon which said limiting impedance is provided.

15. A tube as claimed in claim 1, wherein said tube comprises an electron source for a traveling wave tube.

* * * * *